US009719499B2

(12) United States Patent
Campbell et al.

(10) Patent No.: US 9,719,499 B2
(45) Date of Patent: Aug. 1, 2017

(54) SLIPPER RETAINER BALL FOR HYDRAULIC UNIT

(71) Applicant: Hamilton Sundstrand Corporation, Charlotte, NC (US)

(72) Inventors: Kris H. Campbell, Poplar Grove, IL (US); Glenn C. Lemmers, Jr., Loves Park, IL (US); Mark J. Franklin, Janesville, WI (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 440 days.

(21) Appl. No.: 14/598,301

(22) Filed: Jan. 16, 2015

(65) Prior Publication Data

US 2016/0208785 A1 Jul. 21, 2016

(51) Int. Cl.

| | |
|---|---|
| ***F04B 1/12*** | (2006.01) |
| ***F04B 1/14*** | (2006.01) |
| ***F04B 1/20*** | (2006.01) |
| ***F03C 1/06*** | (2006.01) |

(52) U.S. Cl.

CPC ..... *F04B 1/126* (2013.01); *F03C 1/0602* (2013.01); *F03C 1/0634* (2013.01); *F04B 1/141* (2013.01); *F04B 1/146* (2013.01); *F04B 1/148* (2013.01); *F04B 1/2014* (2013.01); *F04B 1/2078* (2013.01); *F04B 1/2085* (2013.01); *F04B 1/2092* (2013.01)

(58) Field of Classification Search

CPC ..... F04B 1/126; F04B 1/2085; F04B 1/2092; F03C 1/0671; F03C 1/0673

USPC ..... 92/71

See application file for complete search history.

(56) References Cited

U.S. PATENT DOCUMENTS 3,292,553 A * 12/1966 Hann ..... F01B 3/0041 91/485
3,303,794 A * 2/1967 Hagemann ..... F01B 3/0032 91/506
3,382,793 A * 5/1968 Gantzer ..... F01B 3/0041 91/499

(Continued)

FOREIGN PATENT DOCUMENTS

JP 04272482 A 9/1992

OTHER PUBLICATIONS

International Search Report, International Application No./Patent No. 16151669.5-1608, Date of Mailing May 20, 2016, European Patent Office; International Search Report 8 pages.

*Primary Examiner* — Thomas E Lazo
(74) *Attorney, Agent, or Firm* — Cantor Colburn LLP

(57) ABSTRACT

A slipper retainer ball of a hydraulic unit having an aperture passing through a body, the body having a flat bottom surface, a flat top surface, an external curved surface, and an interior profiled surface that extends in an axial direction from the bottom surface to the top surface. The interior profiled surface includes a first surface extending parallel to the axis from the bottom surface in the axial direction, a second surface extending perpendicular to the axis from the first surface and outward toward the external curved surface, a third surface extending from the second surface axially at a first angle, a fourth surface extending from the third surface in the axial direction, and a fifth surface extending from the fourth surface to the top surface at a second angle that is skew from the axis. The axial thickness of the body is about 0.471 inches.

12 Claims, 6 Drawing Sheets

(56) References Cited

U.S. PATENT DOCUMENTS

| | | | | |
|---|---|---|---|---|
| 3,522,759 | A | 8/1970 | Martin | |
| 3,678,804 | A * | 7/1972 | Heyl | F01B 3/0088 91/507 |
| 3,810,715 | A | 5/1974 | Week et al. | |
| 5,862,704 | A * | 1/1999 | Seljestad | F04B 1/2085 74/60 |
| 7,975,600 | B2 * | 7/2011 | Beck | F04B 1/126 92/57 |
| 8,037,808 | B2 * | 10/2011 | Bergmann | F04B 1/124 92/57 |
| 8,677,884 | B2 * | 3/2014 | Ogasawara | F01P 5/04 91/1 |
| 9,410,540 | B2 * | 8/2016 | Mizoguchi | F03C 1/0671 |
| 2010/0287926 | A1 | 11/2010 | Ogasawara et al. | |

* cited by examiner

SLIPPER RETAINER BALL FOR HYDRAULIC UNIT

BACKGROUND OF THE INVENTION

Exemplary embodiments of this invention generally relate to an integrated drive generator, and more particularly, to a slipper retainer ball of a hydraulic unit of an integrated drive generator.

Aircrafts currently rely on electrical, pneumatic, and hydraulic systems for secondary power. A typical electrical system utilizes an integrated drive generator coupled to each engine of the aircraft to provide a fixed frequency power to a power distribution system and associated loads. One type of integrated drive generator includes a generator, a hydraulic unit, and a differential assembly arranged in a common housing. The differential assembly is operably coupled to an aircraft engine, such as a gas turbine engine, via an input shaft. The rotational speed of the input shaft varies during the operation of the engine. The hydraulic unit cooperates with the differential assembly to provide a constant speed to the generator throughout engine operation.

Due to engineering designs and requirements various components of the systems must be designed to operatively function together. For example, various components of the hydraulic unit are configured to appropriately and accurately mate and fit together to enable efficient operation.

BRIEF DESCRIPTION OF THE INVENTION

According to one embodiment of the invention, a slipper retainer ball of a hydraulic unit is provided. The slipper retainer ball having a partial spherical body having an aperture passing through a center of the body and defining an axis, the body having a flat bottom surface, a flat top surface, an external curved surface, and an interior profiled surface that extends in an axial direction from the bottom surface to the top surface. The interior profiled surface includes a first surface extending parallel to the axis from the bottom surface in the axial direction, a second surface extending perpendicular to the axis from the first surface and radially outward toward the external curved surface, a third surface extending from the second surface in the axial direction at a first angle that is skew from the axis, a fourth surface extending from the third surface parallel to the axis and in the axial direction, and a fifth surface extending from the fourth surface to the top surface at a second angle that is skew from the axis. The axial thickness of the body extending between the bottom surface and the top surface is about 0.471 inches (1.196 cm).

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example, with reference to the drawings.

DETAILED DESCRIPTION OF THE INVENTION

Figure 1:
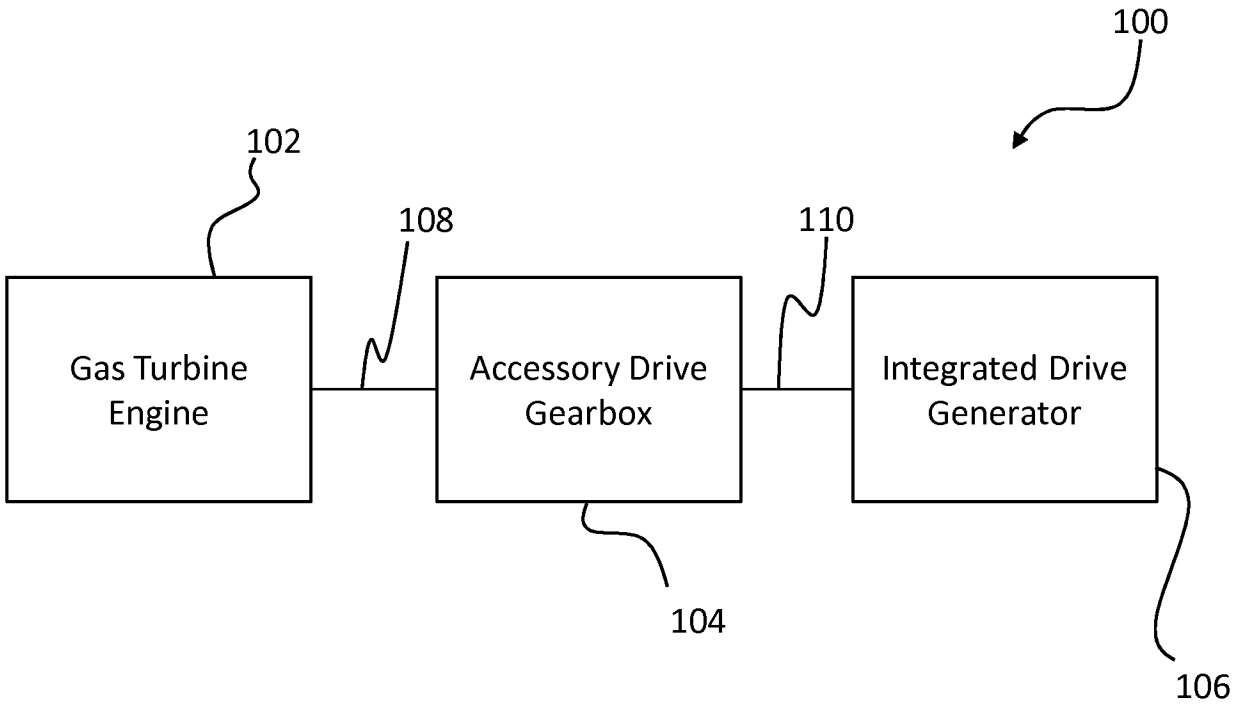
FIG. 1 is a schematic diagram of an exemplary power generator system of an aircraft.

Referring now to FIG. 1, an example of a generator system 100 is schematically illustrated. The generator system 100 includes a gas turbine engine 102 that is configured to rotationally drive an integrated drive generator 106 through an accessory drive gearbox 104 mounted on the gas turbine engine 102. The accessory drive gearbox 104 is coupled to a spool 108 of the gas turbine engine 102, and the speed of the spool 108 varies throughout the entire operation of the gas turbine engine 108, depending on operational characteristics, such as high altitude cruising flight or take-off of the aircraft. An input shaft 110 is configured to transfer rotational energy to the integrated drive generator 106 from the accessory drive gearbox 104. Those skilled in the art will appreciated that the generator system of FIG. 1 directed to an aircraft is merely presented for illustrative and explanatory purposes and other generators systems and/or engines may be used without departing from the scope of the invention.

Figure 2:
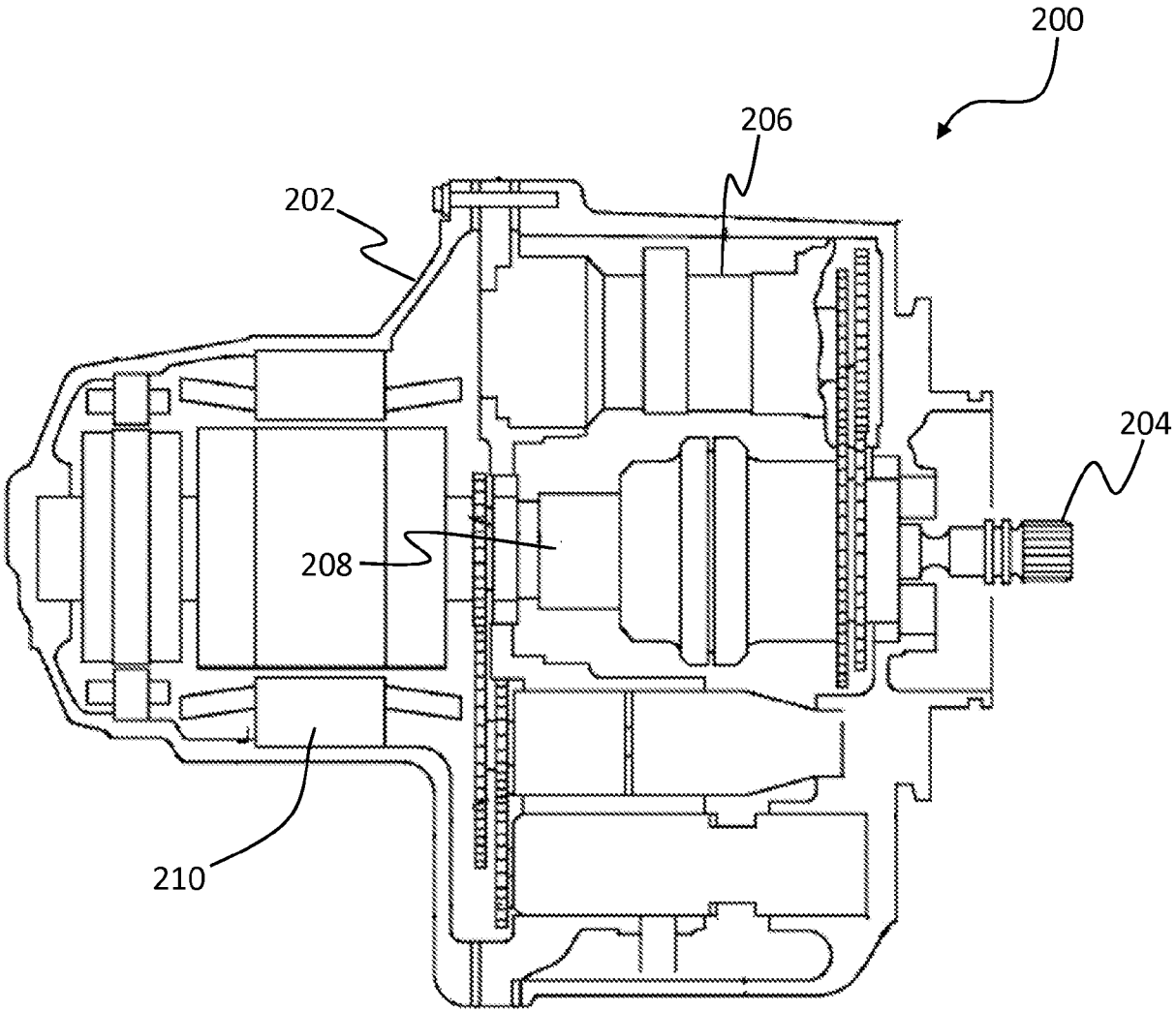
FIG. 2 is a cross-sectional schematic view of an example of an integrated drive generator.

An example of an integrated drive generator 200 including a housing 202 is shown in FIG. 2. In the illustrated embodiment, the integrated drive generator 200 includes an input shaft 204 configured to receive rotational drive from an accessory drive gearbox (see FIG. 1). The rotational speed of the input shaft 204 varies depending upon the operation of the engine (see FIG. 1). To this end, a hydraulic unit 206 cooperates with a differential assembly 208 to convert the variable rotational speed from the input shaft 204 to a fixed rotational output speed that is transferred to a generator 210.

Figure 3:
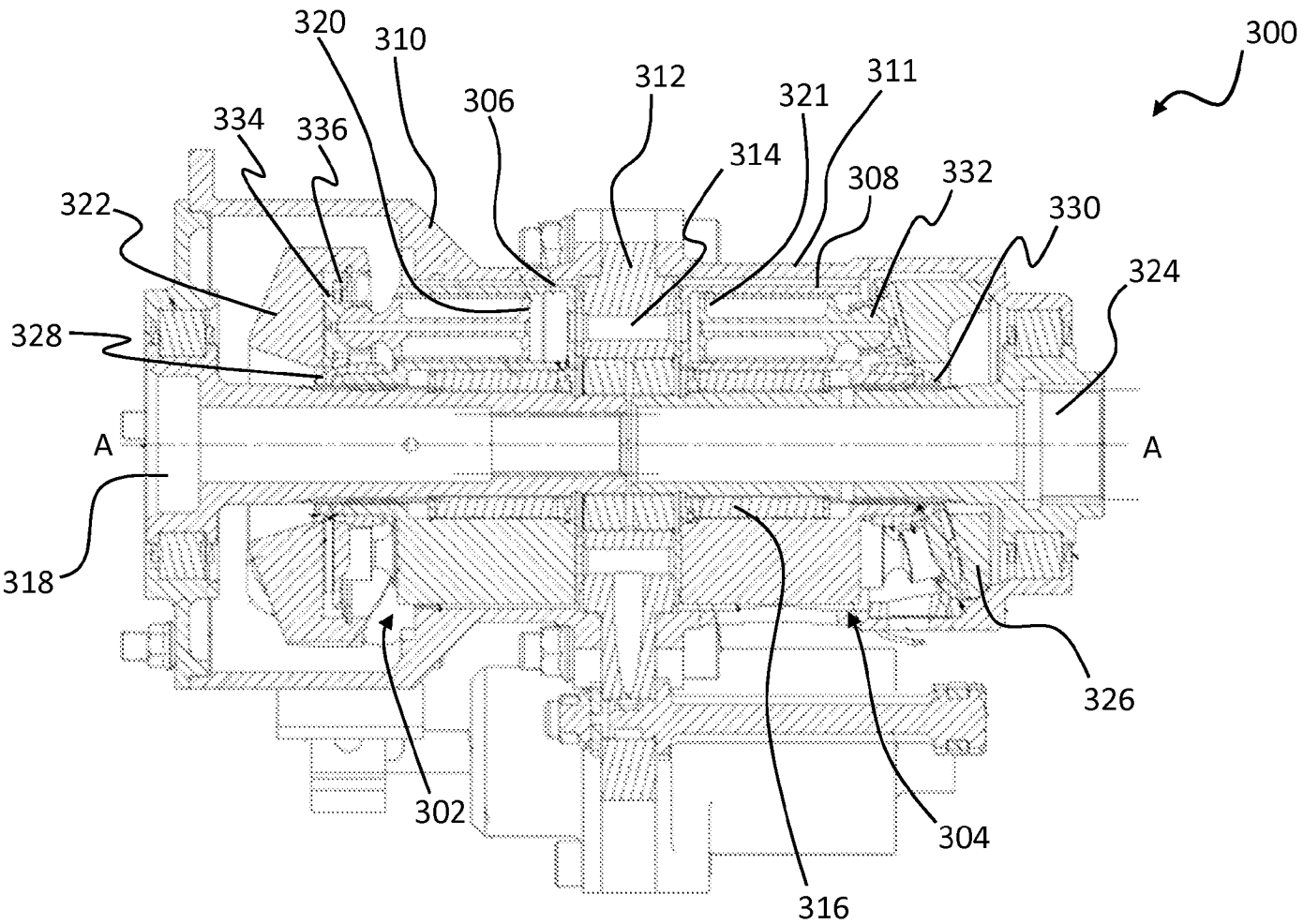
FIG. 3 is a cross-sectional schematic view of an example of a hydraulic unit of an integrated drive generator.

Referring now to FIG. 3, an exemplary embodiment of a hydraulic unit 300 of an integrated drive generator is shown. The hydraulic unit 300 includes a variable displacement hydraulic pump 302 and a fixed displacement hydraulic motor 304. The variable displacement hydraulic pump 302 and the fixed displacement hydraulic motor 304 have respective cylinder blocks 306 and 308 which are arranged for rotation about a common axis A within housings 310, 311 on opposite sides of a stationary port plate 312 of the hydraulic unit 300. The port plate 312 is formed with one or more kidneys or apertures 314 through which hydraulic fluid communication between the pump 302 and the motor 304 is established during normal operation of the hydraulic unit 300. A biasing mechanism 316 resiliently biases the cylinder blocks 306, 308 in the direction of the port plate 312.

The operation of the hydraulic unit 300 in an integrated drive generator, for example an integrated drive generator of an aircraft, involves transmission of torque from an engine of the aircraft to an input, which rotates an input shaft 318 of the hydraulic unit 300 about axis A. The cylinder block 306 of the pump 302 is connected to the input shaft 318 for rotation therewith. Pistons 320 within the cylinder block 306 of the pump 302 are displaced during rotation an amount which is a function of the setting of a variable swash plate or wobbler 322 of the pump 302. Similarly, pistons 321 within the cylinder block 308 of the motor 304 are displaced during rotation an amount which is a function of the setting of a variable swash plate or wobbler 322 of the pump 302. Those of skill in the art will appreciate that any number of pistons and associated apertures may be employed without departing from the scope of the invention. For example, in one exemplary embodiment, the system may include nine pistons in each of the motor and the pump, and nine apertures may pass through the port plate. Further, for example, the number of apertures is not dependent on the number of pistons, and in some embodiments there may be five apertures when nine pistons are employed. Thus, the number of pistons and the number apertures may be varied without departing from the scope of the invention.

Hydraulic fluid under pressure from the hydraulic pump 302 is delivered to the hydraulic motor 304 through the apertures 314 of port plate 312 for rotating the cylinder block 308 and an output shaft 324 to which the cylinder block 308 is fixedly connected. The swash plate or wobbler 326 of the motor 304 is fixedly configured so that an operating speed of the motor 304 is a function of a displacement of the pump 302. The rotary output from output shaft 324 is added to or subtracted from the rotary motion from the engine through a conventional differential gearing of an integrated drive generator for operating an electrical generator at a substantially constant rotational speed. That is, since the speed of the rotation from the aircraft engine to the input shaft 318 of the hydraulic unit 300 will vary, the position of the variable wobbler 322 is adjusted in response to these detected speed variations for providing the necessary reduction or increase in the rotational speed for obtaining a desired constant output speed to the generator. During normal operation, there is a hydrostatic balance of the cylinder blocks 306, 308 and port plate 312. Although the hydraulic unit 300 illustrated and described herein refers to the variable unit as a pump 302 and the fixed unit as a motor 304, hydraulic units having other configurations, such as where the variable unit functions as a motor and the hydraulic unit operates as a pump for example, are within the scope of the invention.

During operation, the wobbler 322 is permitted to turn, rotate, tumble, and/or wobble about a retainer ball 328. The wobbler 322 is configured to wobble, etc., in part, as a result of the movement of the pistons 320, 321, respectively. A retainer ball 330 is configured to turn or rotate with respect to the wobbler 326. Each piston 320, 321 has a ball 332 (ball of piston 320 not labeled for clarity) on one end. The ball 332 of the pistons 320, 321 is retained within a slipper 334. The slipper 334 is retained by a slipper retainer 336. The slipper retainer 336 enables the slipper 334 to be held in contact with the wobbler 322, 326, thus enabling operational coupling and/or contact between the wobblers 322, 326 and the pistons 320, 321, respectively, of the pump 302 and the motor 304.

Figure 4A:
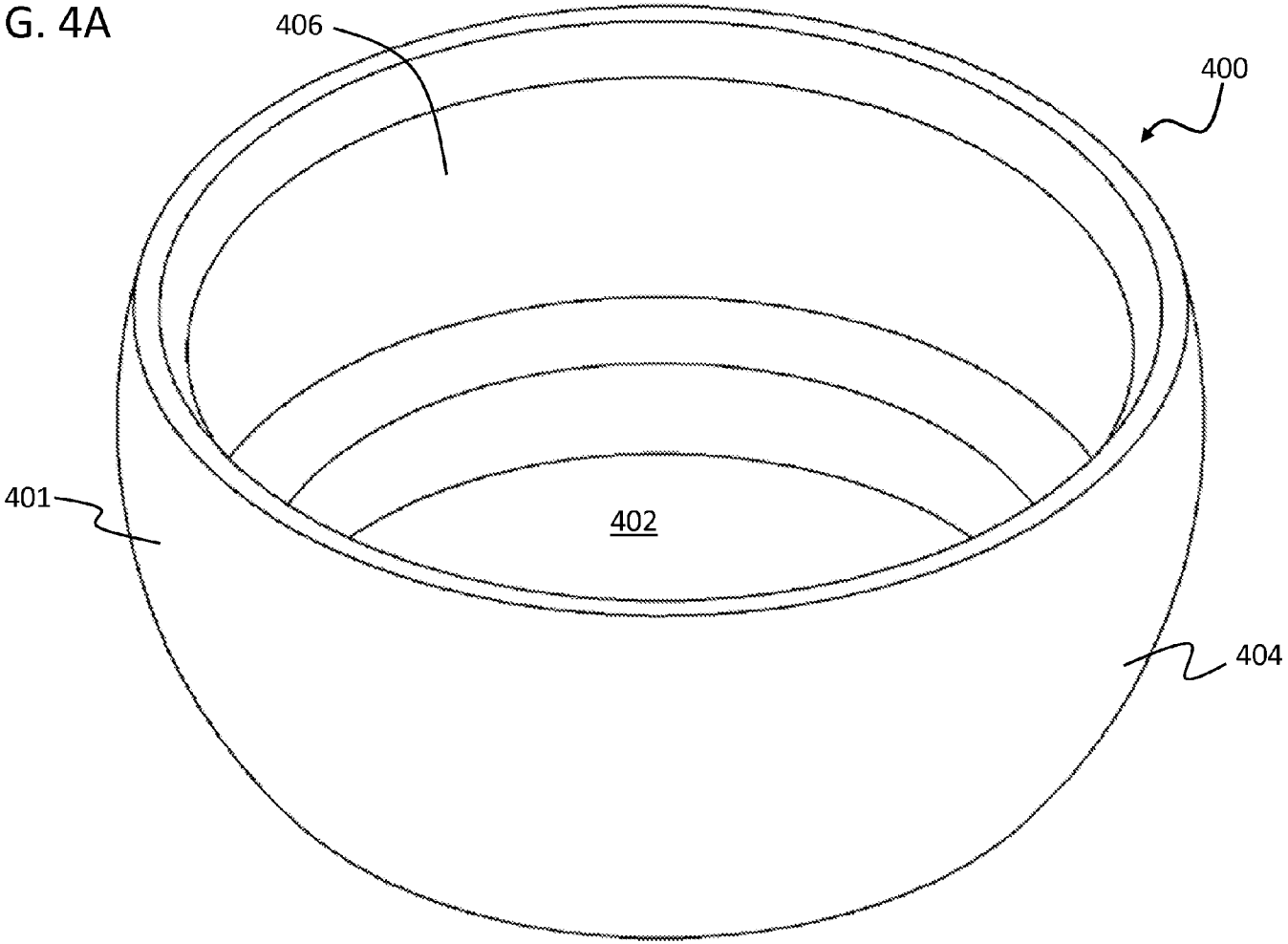
FIG. 4A is an isometric view of a slipper retainer ball in accordance with an exemplary embodiment of the invention.
Figure 4B:
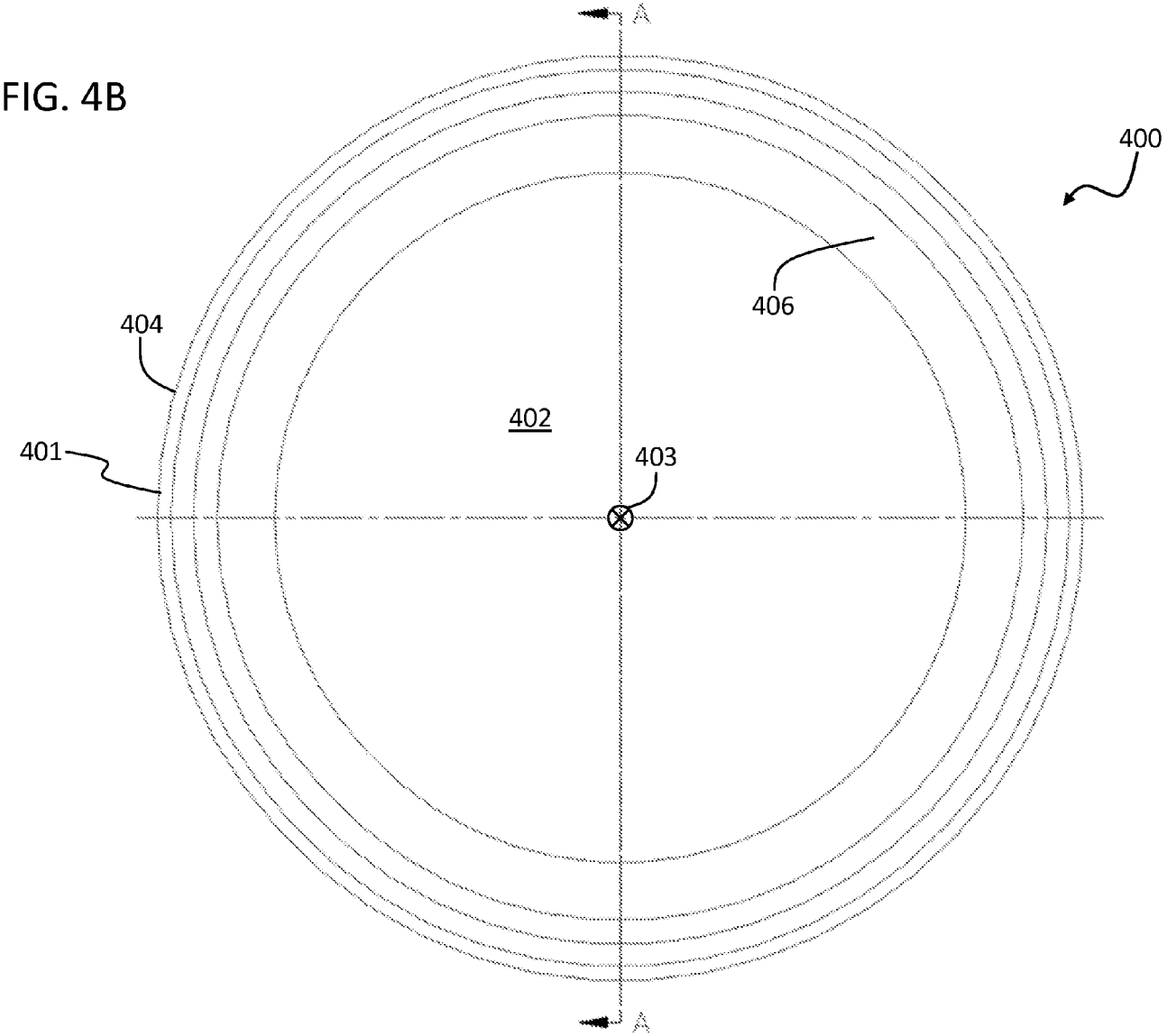
FIG. 4B is a top plan view of the slipper retainer ball of FIG. 4A.
Figure 4C:
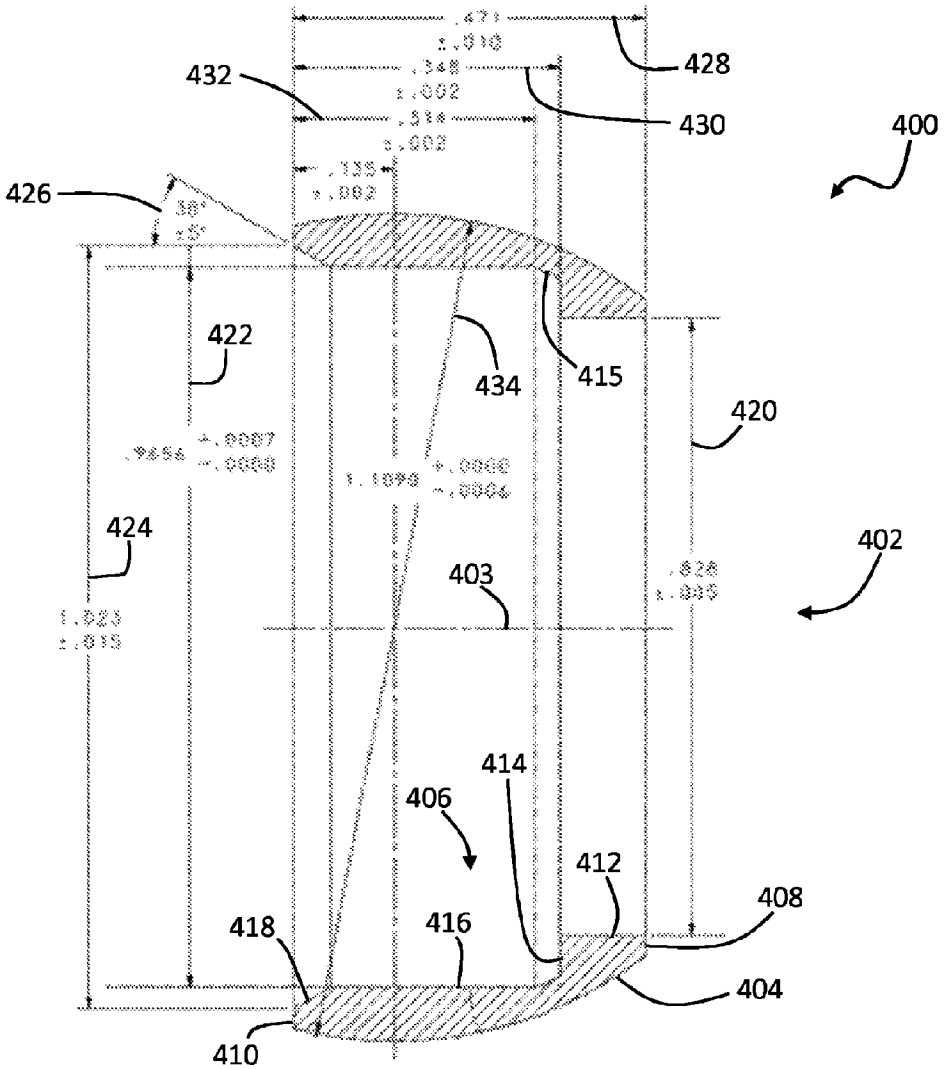
FIG. 4C is a cross-sectional view of the slipper retainer ball of FIGS. 4A and 4B as viewed along the line A-A of FIG. 4B.

Turning now to FIGS. 4A-4C, various views of an exemplary slipper retainer ball 400 in accordance with embodiments of the invention are shown. FIG. 4A is an isometric view of the slipper retainer ball 400; FIG. 4B is a top plan view of the slipper retainer ball 400; and FIG. 4C is a cross-sectional view of the slipper retainer ball 400 as viewed along the line A-A of FIG. 4B.

As shown in FIG. 4A, slipper retainer ball 400 is formed of a partial substantially spherical body 401 that includes a central aperture 402. The body 401 has a substantially smooth curved exterior surface 404 and a formed or tiered interior surface 406. Central aperture 402, and interior surface 406, is configured to slidably engage with a shaft, such as input shaft 318 or output shaft 324 of FIG. 3. The external surface 404 is configured to slidably engage with a slipper retainer 336. FIG. 4B is a top plan view of the slipper retainer ball 400, showing the central aperture 402

Turning now to FIG. 4C, the dimensions of the slipper retainer ball 400 are shown. FIG. 4C is a cross-sectional view of the slipper retainer ball 400 as viewed along the line A-A shown in FIG. 4B. A central axis 403 extends axially through the slipper retainer ball 400.

The slipper retainer ball 400 forms a semi-bowl shape, with a flat bottom surface 408 and a flat top surface 410. The exterior surface 404 is a smooth arcuate surface that extends from the bottom surface 408 to the top surface 410. On the inside of the slipper retainer ball 400, the interior surface 406 is comprised of multiple surfaces that are configured to enable movable engagement between the slipper retainer ball 400 and other components of a hydraulic unit, as shown in FIG. 3.

For example, a first surface 412 is located proximal and perpendicular to the flat bottom surface 408. The first surface 412 extends axially from the bottom surface 408 toward the top surface 410 along the direction of the axis 403, and is parallel thereto. A second surface 414 extends perpendicular to the first surface 412 and extends toward the exterior surface 404. The second surface 414 extends radially with respect to the axis 403.

A third surface 415 extends between the second surface 414 outward, in a direction away from the axis 403, toward a fourth surface 416. The third surface 415 is neither parallel nor perpendicular with respect to the axis 403, and thus is angled at a first angle with respect to the axis 403. For example, the angle of surface 415 may be about 23° with a variation of about +/−2°.

A fourth surface 416 extends perpendicular to the second surface 414 and parallel to the first surface 412, i.e., parallel to the axis 403. A fifth surface 418 extends at an angle relative to the axis 403 from the fourth surface 416 to the top surface 410 of the slipper retainer ball 400.

The first surface 412, the second surface 414, the third surface 415, the fourth surface 416, and the fifth surface 418 form an interior profile of the interior surface 406. As shown, various transitions between the surfaces 412, 414, 415, 416, 418 may be right-angle transitions or may be angled. The angles and transitions shown in FIG. 4C are presented for exemplary purposes, and those of skill in the art will appreciate that the interior profile of the interior surface of the slipper retainer ball may be adjusted to appropriately mate and/or fit with other components of a hydraulic unit.

With reference to FIG. 4C, the central aperture 402 has a first diameter 420 of about 0.828 inches (2.103 cm) with a variation of about +/−0.005 inches (0.013 cm) at the bottom of the slipper retainer ball 400. That is, the distance between opposing points on the first surface 412 is about 0.828 inches (2.103 cm) with a variation of about +/−0.005 inches (0.013 cm).

The central aperture 402 has a second diameter 422 of about 0.9656 inches (2.4526 cm) with a variation of about +0.0007 inches (0.0018 cm) and about −0.0000 inches (0.0000 cm) in a middle portion of the slipper retainer ball 400. Thus, the distance between opposing points on the fourth surface 416 is about 0.9656 inches (2.4526 cm) with a variation of about +0.0007 inches (0.0018 cm) and about −0.0000 inches (0.0000 cm).

The central aperture 402 extends outward from the fourth surface 416 to the top surface 410 along fifth surface 418. At the point that the fifth surface 418 meets or transitions to the top surface 410, the central aperture 402 has a diameter 424 of about 1.023 inches (2.598 cm) with a variation of about 0.015 inches (0.038 cm). The fifth surface 418 is angled at a second angle, from fourth surface 416 to top surface 410, at an angle 426 which is about 30° with a variation of about +/−5°, as measured from the axis 403 of the slipper retainer ball 400.

The axial thickness 428, along axis 403, of the slipper retainer ball 400 is about 0.471 inches (1.196 cm) with a variation of about +/−0.010 inches (0.025 cm). That is, the thickness 428 between the bottom surface 408 and the top surface 410 is about 0.471 inches (1.196 cm) with a variation of about +/−0.010 inches (0.025 cm). The axial thickness 430 from the second surface 414 to the top surface 410 is about 0.348 inches (0.884 cm) with a variation of about +/−0.002 inches (0.005 cm). The axial thickness 432 from the transition point between the third surface 415 and the fourth surface 416 to the top surface 410 is about 0.314 inches (0.798 cm) with a variation of about +/−0.002 inches (0.005 cm).

A diameter 434 of the slipper retainer ball 400 is about 1.1090 inches (2.8169 cm) with a variation of about +0.0000 inches (0.0000 cm) and about −0.0006 inches (0.0015 cm).

FIGS. 4A-4C display certain dimensions not discussed above, but are pertinent and relate to various embodiments and/or alternatives of the invention disclosed herein. Thus, the dimensions detailed on the figures, but not discussed above, are incorporated into this specification.

Advantageously, slipper retainer balls configured in accordance with embodiments of the invention appropriately fit within and operate with specific hydraulic units. Further, advantageously, failure and damage is less likely to occur and efficiency is increased within specific hydraulic units when slipper retainer balls in accordance with embodiments of the invention are employed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments.

Accordingly, the invention is not to be seen as limited by the foregoing description, but is only limited by the scope of the appended claims.

What is claimed is:

1. A slipper retainer ball of a hydraulic unit, comprising:

a partial spherical body having an aperture passing through a center of the body and defining an axis, the body having a flat bottom surface, a flat top surface, an external curved surface, and an interior profiled surface that extends in an axial direction from the bottom surface to the top surface;

the interior profiled surface comprising:

a first surface extending parallel to the axis from the bottom surface in the axial direction;

a second surface extending perpendicular to the axis from the first surface and radially outward toward the external curved surface;

a third surface extending from the second surface in the axial direction at a first angle that is skew from the axis;

a fourth surface extending from the third surface parallel to the axis and in the axial direction; and a fifth surface extending from the fourth surface to the top surface at a second angle that is skew from the axis;

wherein the axial thickness of the body extending between the bottom surface and the top surface is about 0.471 inches (1.196 cm).

2. The slipper retainer ball of claim 1, wherein the axial thickness of the body has a variability of about +/−0.010 inches (0.0.25 cm).

3. The slipper retainer ball of claim 1, wherein a diameter of the aperture along the first surface is about 0.828 inches (2.103 cm) with a variability of about +/−0.005 inches (0.013 cm).

4. The slipper retainer ball of claim 1, wherein a diameter of the aperture along the fourth surface is about 0.9656 inches (2.4526 cm) with a variability of about +0.0007 inches (0.0018 cm) and about −0.0000 inches (0.0000 cm).

5. The slipper retainer ball of claim 1, wherein a diameter of the partial spherical body from radially opposing points on the exterior curved surface is about 1.1090 inches (2.8169 cm) with a variability of about +0.0000 inches (0.0000 cm) and about −0.0006 inches (0.0015 cm).

6. The slipper retainer ball of claim 1, wherein the axial thickness of the body between the top surface and the second surface of the interior profiled surface is about 0.348 inches (0.884 cm) with a variability of about +/−0.002 inches (0.005 cm).

7. The slipper retainer ball of claim 1, wherein the axial thickness of the body between the top surface and a transition point between the third surface and the fourth surface is about 0.314 inches (0.798 cm) with a variability of about +/−0.002 inches (0.005 cm).

8. The slipper retainer ball of claim 1, wherein at least a part of the profiled interior surface of the body is configured to movably engage with a shaft of a hydraulic unit.

9. The slipper retainer ball of claim 1, wherein at least a part of the exterior curved surface of the body is configured to slidably engage with a slipper retainer.

10. The slipper retainer ball of claim 1, wherein the first angle is about 23° with a variation of about +/−2°.

11. The slipper retainer ball of claim 1, wherein the second angle is about 30° with a variation of about +/−5°.

12. The slipper retainer ball of claim 1, wherein the slipper retainer ball is configured within a hydraulic unit.

* * * * *